US007669256B2

(12) United States Patent
Harrow

(10) Patent No.: US 7,669,256 B2
(45) Date of Patent: Mar. 2, 2010

(54) SUPPORT FRAME FOR A BED AND LOCKING MECHANISM THEREFOR

(76) Inventor: Lawrence Harrow, 5959 Corvette St., Commerce, CA (US) 90040

( * ) Notice: Subject to any disclaimer, the term of this patent is extended or adjusted under 35 U.S.C. 154(b) by 278 days.

(21) Appl. No.: 11/725,165

(22) Filed: Mar. 16, 2007

(65) Prior Publication Data

US 2008/0222801 A1 Sep. 18, 2008

(51) Int. Cl.
*A47C 19/04* (2006.01)

(52) U.S. Cl. ..... 5/200.1; 5/201; 5/282.1; 403/353

(58) Field of Classification Search ..... 5/285, 5/286, 200.1, 201, 282.1, 202; 403/353
See application file for complete search history.

(56) References Cited

U.S. PATENT DOCUMENTS

| | | | | |
|---|---|---|---|---|
| 2,544,274 | A | | 3/1951 | Moeller |
| 2,639,042 | A | | 5/1953 | Lambert el at |
| 3,713,181 | A | | 1/1973 | Hougland |
| 3,730,108 | A | | 5/1973 | Stroh |
| 3,744,068 | A | | 7/1973 | Harris |
| 3,757,361 | A | | 9/1973 | Harris et al |
| 3,795,022 | A | * | 3/1974 | Harris ..... 5/181 |
| 3,803,644 | A | | 4/1974 | Harris |
| 3,849,012 | A | | 11/1974 | Krouse |
| 3,945,064 | A | | 3/1976 | Harris et al. |
| 4,106,141 | A | * | 8/1978 | Hooker ..... 5/201 |
| 4,225,265 | A | * | 9/1980 | Hooker et al. ..... 403/353 |
| 4,295,234 | A | * | 10/1981 | Whitehead ..... 5/184 |
| 4,444,323 | A | | 4/1984 | Travis |
| 5,161,268 | A | * | 11/1992 | Harrow ..... 5/201 |
| 5,920,930 | A | | 7/1999 | Harrow |
| 6,415,465 | B1 | * | 7/2002 | Harrow ..... 5/201 |

* cited by examiner

*Primary Examiner*—Michael Trettel
(74) *Attorney, Agent, or Firm*—John J. Connors; Connors & Assoc.

(57) ABSTRACT

End portions of a pair of crossbar bed frame members are detachably connected by a locking mechanism including an arm attached by the pivot element to one frame member to rotate between a locked condition and an unlocked condition. One frame member has a first projection and the pivot element includes a second projection. A pair of elongated slots in the frame members receive the projections when the frame members are longitudinally oriented and the end portions are overlapping. The end portions have openings therein that are aligned when the end portions overlap. The arm has a portion that is inserted in the aligned openings when in the locked condition and withdrawn from the aligned openings to allow the frame members to be disconnected and separated when in the unlocked condition.

12 Claims, 3 Drawing Sheets

SUPPORT FRAME FOR A BED AND LOCKING MECHANISM THEREFOR

INCORPORATION BY REFERENCE

The inventor incorporates herein by reference any and all U.S. patents, U.S. patent applications, and other documents, hard copy or electronic, cited or referred to in this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

"Rectangular" includes square.

BACKGROUND OF INVENTION

Bed frames are commonly used devices to support a bed comprising, for example, a boxspring and mattress positioned on top of the boxspring. These bed frames are typically made of steel angle irons that are welded or connected together by various types of connecting devices. A typical connecting device is disclosed in U.S. Pat. No. 5,161,268, where the crossbars of a bed frame have their ends attached by a joint assembly that has an arm mounted on a frame member to rotate between a locked and unlocked position. It would be highly desirable to reduce the costs, and simplify the manufacture of, such connecting devices.

SUMMARY OF INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits. The benefits of this invention include, but are not limited to: a low cost and highly reliable, easier to manufacture locking mechanism for a bed frame.

Without limiting the scope of this invention as expressed by the claims that follow, some, but not necessarily all, of its features are:

One, the locking mechanism of this invention locks together overlapping ends of bed frame members for a bed. It includes a pair of slots in the frame members, a first projection on one frame member, and an arm attached by a pivot element to one frame member to rotate between a locked condition and an unlocked condition. The pivot element includes a second projection, and the slots and projections are in predetermined positions so, upon assembly of the frame members with their ends overlapping, the projections are received in the slots. One slot may be in one frame member and the other slot may be in the other frame member, and the first projection may be on the one frame member and the second projection may be on the other frame member. Alternately, each slot of the pair of slots may be in the same one frame member, and the first and second projections may each be on the other frame member. The projections each may comprise a shoulder rivet with an enlarged head on a stem and the slots each may comprise an enlarged open portion for passage of the head and a narrow open portion connected to the enlarged open portion for receiving the stem.

Two, the frame members may be L-shaped and they may each include an end portion having an openings therein. Upon assembly when longitudinally oriented with the end portions overlapping, the assembled frame members provide a substantially horizontal top section and a substantially vertical side section and the openings are aligned to receive a finger element of the arm. The aligned openings may be in the vertical side section. The finger element may be planar and have cross-sectional dimensions that enable it to fit into the aligned openings. Upon the arm being rotated in one direction, the finger element is inserted into the aligned openings to lock the frame members together and, upon the arm being rotated in the opposite direction, the finger element is withdrawn from the aligned openings to allow the frame members to be disconnected.

Three, the arm may include first and second planar arm elements substantially at a right angle to each other with the pivot element attaching the first planar arm element to the vertical side section so the arm is adapted to be rotated vertically upon assembly of the frame members to support the bed. The finger element may be at or near an end of the second planar arm element, and the second planar arm element may be oriented substantially horizontally and abutting the top section when the frame members are locked together with the finger element inserted into the aligned openings. In a locked condition with the finger inserted in the aligned openings, the second planar arm element may be positioned to be engaged by a bed placed on the bed frame to prevent vertical pivotal movement of the arm.

These features are not listed in any rank order nor is this list intended to be exhaustive.

DESCRIPTION OF THE DRAWING

Some embodiments of this invention, illustrating all its features, will now be discussed in detail. These embodiments depict the novel and non-obvious bed frame locking mechanism of this invention for a bed frame as shown in the accompanying drawing, which is for illustrative purposes only. This drawing includes the following figures (Figs.), with like numerals indicating like parts.

DETAILED DESCRIPTION OF SOME EMBODIMENTS OF THIS INVENTION

Figure 1:
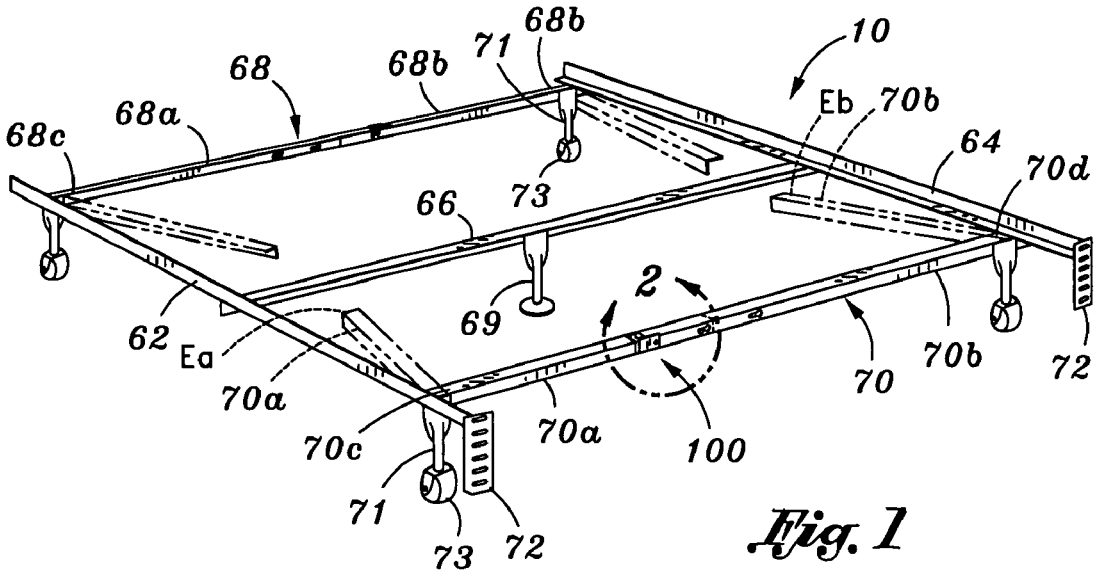
FIG. 1 is a perspective view of a bed frame employing one embodiment of the locking mechanism of this invention locking together bed frame members.

As depicted in FIG. 1 one embodiment of the bed frame of this invention, generally designated by the numeral 10, includes a pair of L-shaped side rails 62 and 64 that are connected together by a center bar 66 and a pair of crossbars 68 and 70. At the ends of each of the side rails 62 and 64 are headboard brackets 72. Typically, the opposed ends of the center bar 66 are bolted, or otherwise connected to, the central portions of the side rails 62 and 64 and a leg 69 extends downward from the middle of the center bar to rest on a floor (not shown). At each corner of the bed frame 10 are legs 71 with casters 73 that rest on the floor.

The crossbar 68 comprises a pair of metallic, typically steel, L-shaped crossbar frame members 68*a* and 68*b* and the crossbar 70 comprises a pair of metallic, typically steel, L-shaped crossbar frame members 70*a* and 70*b*. As shown in FIG. 1, the inner ends 68*c* and 68*d* and 70*c* and 70*d* of each of the crossbar frame members 68*a*, 68*b*, 70*a* and 70*b* are connected to a corresponding side rail 62 or 64, as the case may be. Preferably, each of the crossbar frame members 68*a*, 68*b*, 70*a* and 70*b* are pivotally attached to a side rail. This enables the crossbar frame members 68*a*, 68*b*, 70*a* and 70*b* to be folded inwardly against their respective side rails during storage and shipment as shown in dotted lines in FIG. 1.

During assembly, the crossbar frame members 68*a*, 68*b*, 70*a* and 70*b* are moved outwardly at a right angle with respect to the side rail to which they are attached. The two side rails 62 and 64 are then positioned opposite each other and in parallel, and each pair of crossbar frame members 68*a* and 68*b*, and 70*a* and 70*b*, are aligned and their respective outer end portions are brought into an overlapping, nesting, and abutting relationship and are detachably connected by one embodiment of the locking mechanism of this invention generally designated by the numeral 100. The precise manner in which this is accomplished is discussed in detail with respect to the crossbar frame members 70*a* and 70*b* in connection with FIGS. 2 through 5. The crossbar frame members 68*a* and 68*b* are attached and detached in the same manner as the crossbar frame members 70*a* and 70*b*.

Referring to FIGS. 2 through 5, the outer ends Ea and Eb, respectively of the crossbar frame members 70*a* and 70*b* are positioned to overlap. Each crossbar frame member 70*a* and 70*b* has an L-shaped cross section with top walls 70*g* and 70*h*, respectively, adjoined at right angles, respectively, to the side walls 70*i* and 70*j*. Upon assembly the frame member 70*b* overlies the frame member 70*a*, and the locking mechanism 100 orients each frame member 70*a* and 70*b* so each individual frame member provides a substantially horizontal top planar section, namely, the individual walls 70*g* and 70*h*, and a substantially vertical side planar section, namely, the individual walls 70*i* and 70*j*. As best illustrated in FIGS. 2A and 2B, each of these bed frame members 70*a* and 70*b* includes an end portion, namely, end portion A and end portion B respectively, with an opening therein, namely opening x and opening y, respectively, and an elongated, keyhole slot, namely slot s1 and slot s2.

The openings x and y are each of substantially identical configuration, generally being oblong and having essentially the same dimensions. The slots s1 and s2 are each of substantially identical configuration, having essentially the same dimensions. As best shown in FIG. 2A, these slots s1 and s2 each comprise an enlarged open portion 101 and a narrow open portion 101*a* connected to the enlarged open portion. The narrow open portions 101*a* of the slots s1 and s2 point towards each other. The openings x and y are in the horizontal top planar sections respectively of the frame members 70*a* and 70*b*, with the opening x inward of the outer end Ea of the frame member 70*a* a substantial distance, for example, substantially from 1 to 30 inches, and the opening y is at or nearby the outer end Eb of the frame member 70*b*. The slot s2 is in the vertical side planar section or side wall 70*i* and inward of the outer end Ea of the frame member 70*a* a substantial distance, for example, substantially from 1 to 30 inches. The slot s1 is in the vertical side planar section or side wall 70*j* and inward of the outer end Eb of the frame member 70*b* a substantial distance, for example, substantially from 1 to 30 inches. A shoulder rivet at or nearby the outer end Ea of the frame member 70*a* projects outward from an exterior surface of this frame member's vertical side wall 70*i* to provide one projection P1 for coupling together the frame members 70*a* and 70*b*. Upon assembly and the locking mechanism 100 in a locked condition as depicted in FIG. 2, the frame members 70*a* and 70*b* are longitudinally oriented with the end portions A and B overlapping and the openings x and y aligned and in registration.

Figure 2:
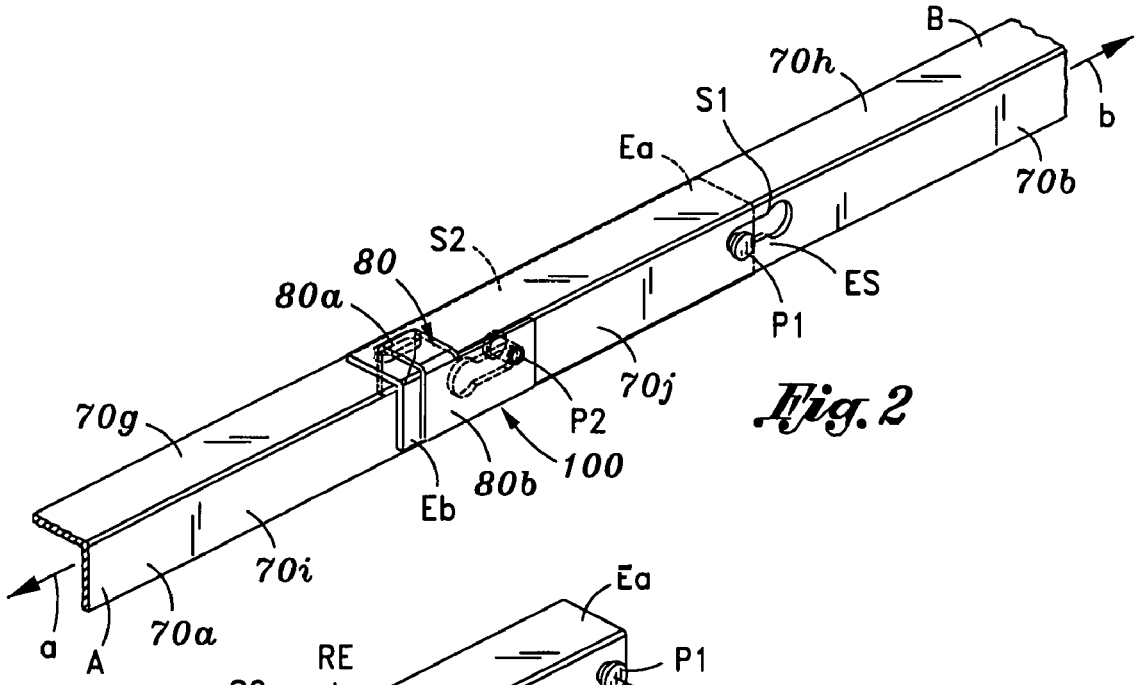
FIG. 2 is an enlarged fragmentary perspective view taken along line 2 of FIG. 1, showing the locking mechanism in a locked condition.
Figure 2B:
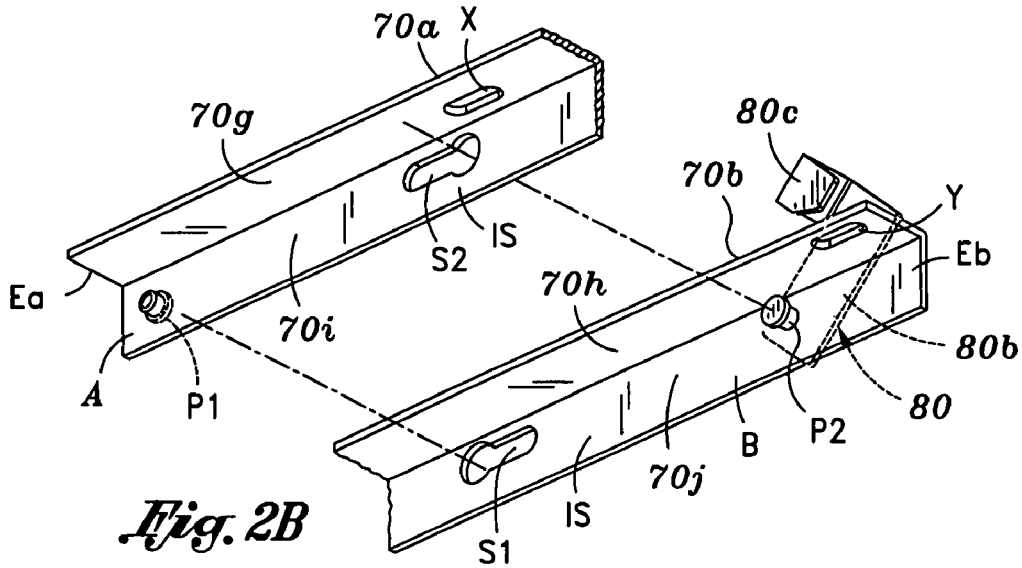
FIG. 2B is an exploded perspective view showing the interiors of the outer end portions of the bed frame members.
Figure 3:
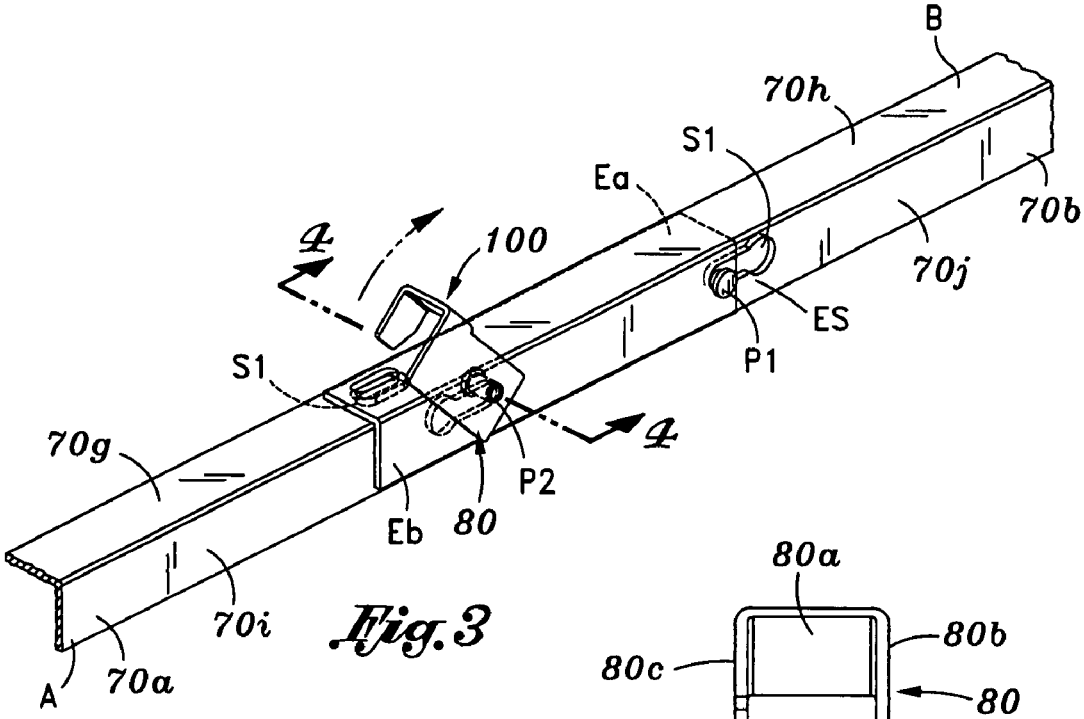
FIG. 3 is an enlarged fragmentary view similar to FIG. 2 showing an arm of the locking mechanism rotated into an unlocked condition to enable disconnecting the bed frame members.
Figure 4:
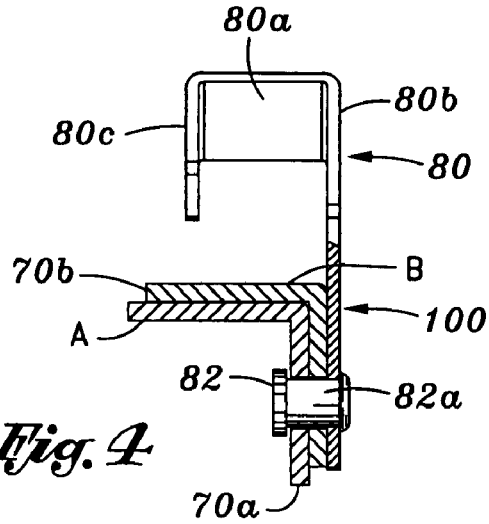
FIG. 4 is a cross-sectional view taken along line 4-4 of FIG. 3.
Figure 5:
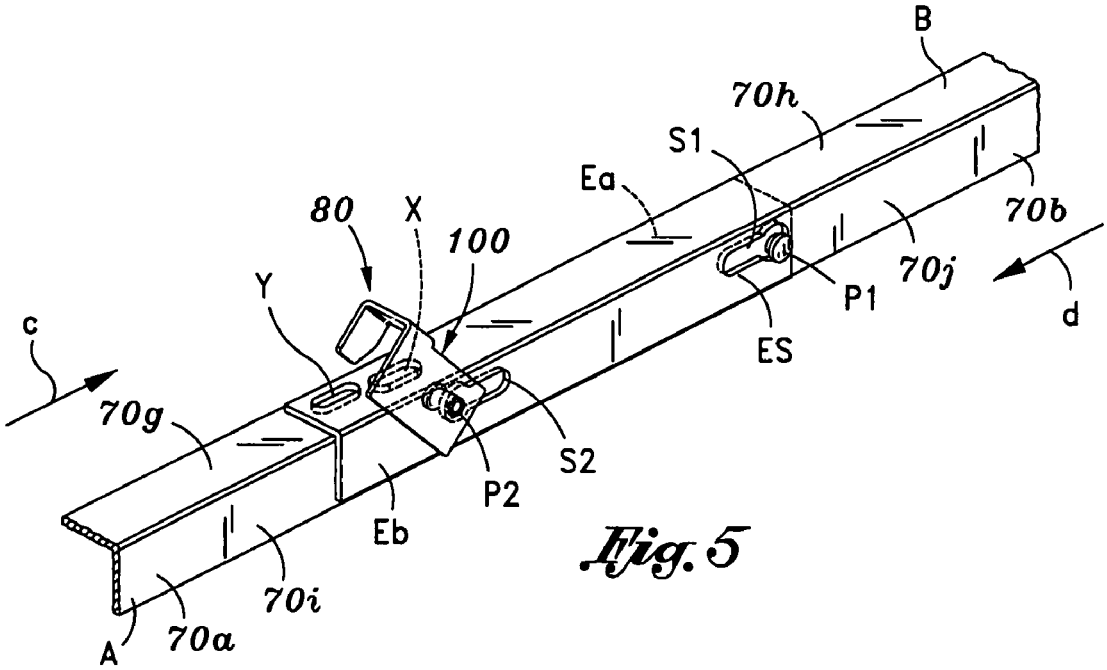
FIG. 5 is an enlarged fragmentary view similar to FIG. 3 showing the arm of the locking mechanism rotated to enable disconnecting the frame members and the frame members moved towards each other to allow them to be separated.

A pivot element such as, for example, a shoulder rivet, mounts an arm 80 on the exterior of the vertical side section or wall 70*j* of the frame member 70*b* to enable the arm to be rotated between a locked condition as shown in FIG. 2 and an unlocked condition as shown in FIGS. 3 and 4. As best illustrated in FIG. 2B, another shoulder rivet provides a second projection P2 that projects outward from an interior surface IS of the vertical side wall 70*j*. As depicted in FIG. 4, both shoulder rivets forming the projections P1 and P2 each comprise an enlarged head 82 on the stem 82*a*. The projections P1 and P2 interact with the slots s1 and s2 upon connecting and disconnecting the frame members 70*a* and 70*b*. When connecting the frame members 70*a* and 70*b*, an individual head 82 first passes through the enlarged open portion 101 and a stem 82*a* travels along the narrow open portion 101*a* as the frame members 70*a* and 70*b* are moved away from each other until the stem abuts a remote end RE furthest displaced from the enlarged open portion 101. When disconnecting the frame members 70*a* and 70*b*, these frame members are first moved towards each other, so the stem 82*a* moves away from the remote end RE and travels along the narrow open portion 101*a* until the head 82 is aligned with the enlarged open portion 101. The underside of the enlarged head 82 slides over the exterior surface surrounding the narrow open portion 101*a* as the overlapping frame members 70*a* and 70*b* move relative to each other.

Figure 2A:
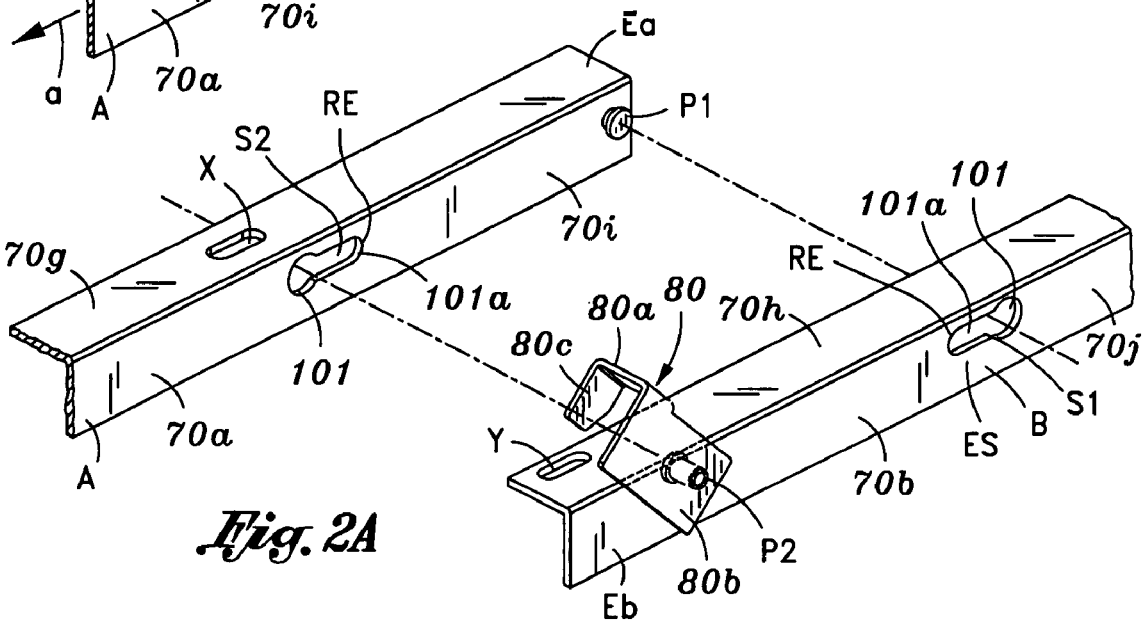
FIG. 2A is an exploded perspective view showing the exteriors of the outer end portions of the bed frame members.

As depicted in FIG. 2A, the arm 80 is in an unlocked condition and the frame members 70*a* and 70*b* are disconnected and separated. Upon connection of these frame members 70*a* and 70*b*, an individual head 82 of the projections P1 and P2 first passes through an enlarged opening in one of slots s1 or s2, as the case may be, with the individual stem 82*a* to which this head is attached aligned with the narrow open portion 101*a* connected to this enlarged open portion 101. Thus, when the frame members 70*a* and 70*b* are manually moved towards or away from each other, the stem 82*a* moves along the narrow open portion and the underside of the enlarged head 82 bears against surrounding frame structure. For example, as depicted in FIG. 2 during connection of the frame members 70*a* and 70*b* when these members are moved away from each other as indicated by the arrow a and b, the underside of the enlarged head 82 of the projection P1 rides along an exterior surface ES of the vertical side wall 70*j* of the frame member 70*b* surrounding the narrow open portion until it abuts the remote end RE of the narrow open portion 101*a* of the slot s2. Concurrently, the underside of the enlarged head 82 of the projection P2 rides along an interior surface IS of the vertical side wall 70*i* of the frame member 70*b* surrounding the narrow open portion 101*a* until it abuts the remote end RE of the narrow open portion of the slot s1. Upon disconnecting the frame members 70*a* and 70*b* when they are manually moved towards each other as indicated by the arrow c and d in FIG. 5, the projections P1 and P2 travel in the slots s1 and s2 in the same manner along the narrow open portion 101*a* towards the enlarged open portion 101 until aligned therewith so their heads 82 may be withdrawn from the slots to disconnect and separate the frame members 70*a* and 70*b*.

The arm 80 includes a pair of planar arm elements 80*a* and 80*b* substantially at a right angle to each other and a planar finger portion 80*c* substantially at a right angle to the one arm element 80*a*. The pivot element, namely, the stem 82*a* of the shoulder rivet serving as the projection P2, passes through an aperture in a lower portion of the one arm element 80*b* and an aligned aperture in the vertical side wall 70*j* of the frame member 70*b*. This allows the arm 80 to be manually rotated vertically upon assembly of the frame members 70*a* and 70*b* to support a bed. The cross-sectional dimensions of the finger portion 80*c* are substantially the same as (through slightly less than) the dimensions of the openings x and y. This facilitates insertion of the finger portion 80*c* in the aligned openings x and y when the locking mechanism 100 is in the locked condition and withdrawal therefrom to place the locking mechanism in the unlocked condition to allow the frame members 70*a* and 70*b* to be disconnected and separated.

Upon the arm 80 of the locking mechanism being rotated in one direction, the finger portion 80*c* is inserted into the aligned openings x and y to coupled and lock the frame members 70*a* and 70*b* together and, upon the arm being rotated in the opposite direction, the finger portion 80*c* is withdrawn from the aligned openings x and y to allow the frame members 70*a* and 70*b* to be disconnected and separated. In the locked condition and the bed frame 10 horizontally disposed, the arm element 80*a* is oriented substantially horizontally and abutting the top wall 70*h* when the frame members 70*a* and 70*b* are locked together with the planar finger portion 80*c* inserted into the aligned openings x and y. When in the locked condition with the finger portion 80*c* inserted in the aligned openings x and y, the arm element 80*a* is positioned to be engaged by a bed (not shown) placed on the bed frame 10 to prevent vertical pivotal movement of the arm 80.

In the embodiment of this invention shown in FIGS. 1 through 5, the pair of slots s1 and s2 and the projections P1 and P2 are on different frame members, namely, the slot s1 and the projection P2 are on the frame member 70*b* and slot s2 and the projection P1 are on the frame member 70*a*. In the embodiment of the locking mechanism of this invention shown in FIG. 6 and generally designated by the numeral 200, the pair of slots s1 and s2 are on the same frame member 70*a* and the projections P1 and P2 are on the same frame member 70*b*. In the locking mechanism 200 both projections P1 and P2 extend at a right angle outward from the inside surface IS of the side wall 70*j*. Note that in both locking mechanisms 100 and 200 the slots s1 and s2 are substantially aligned longitudinally with their respective narrow open portions 101*a* pointing towards each other and their respective enlarged open portions 101 being at maximum displacement from each other.

Figure 6:
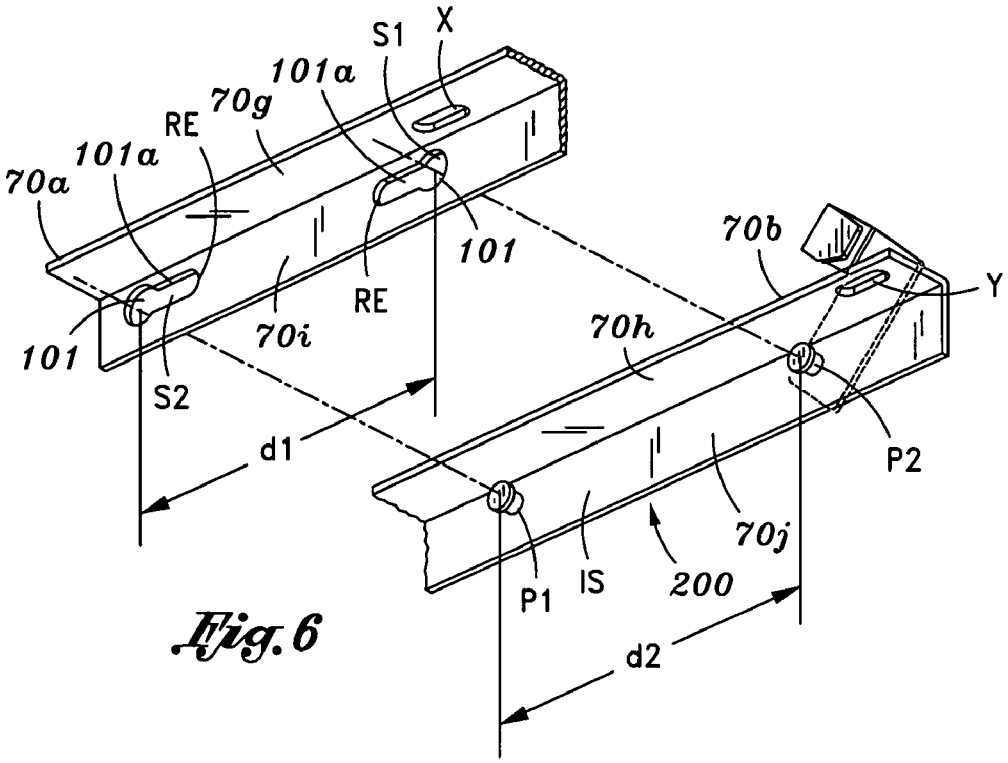
FIG. 6 is an exploded perspective view showing the interiors of the outer end portions the cross bar frame members of an alternate embodiment of this invention.

In both locking mechanisms 100 and 200, the slots s1 and s2 and projections P1 and P2 are in predetermined positions along the frame members 70*a* and 70*b* so, upon assembly of these frame members with their ends A and B overlapping, the projections are received in the slots. The individual slots s1 and s2 are positioned relative to each other so their respective narrow open portions 101*a* point towards each other and are in substantial alignment with each other when the frame members 70*a* and 70*b* are longitudinally oriented and their outer ends A and B are overlapping. In other words, whether the slots s1 and s2 are on the same or different frame members, they are in substantial alignment. Moreover, as illustrated in FIG. 6, the enlarged open portions 101 are spaced apart a predetermined distance $d_1$, for example, substantially from substantially from 2 to 32 inches. The individual projections P1 and P2 are spaced apart a distance $d_2$ substantially equal to the distance $d_1$ between the enlarged open portions.

Upon connection, the projections P1 and P2 first pass through aligned enlarged open portions 101 and then slide sideways along the respective narrow open portions 101*a* as the frame members are manually moved away from each other laterally until the stems abut the remote ends RE of the narrow open portions. The heads 82 of the projections P1 and P2 first pass through aligned enlarged open portions 101 and then slide sideways along the respective narrow open portions 101*a* as the frame members 70*a* and 70*b* are manually moved away from each other laterally until the stems 82*a* of the projections P1 and P2 abut the remote ends RE of the narrow open portions. Upon disconnection, the frame members 70*a* and 70*b* are first manually moved laterally towards each other until the heads 82 of the projections P1 and P2 are aligned enlarged open portions 101 and then the frame members are separated with the heads 82 passing through the enlarged open portions 101.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A locking mechanism for locking together overlapping ends of bed frame members for a bed, comprising a pair of slots in the frame members, a first projection on one frame member, an arm attached by a pivot element to one frame member to rotate between a locked condition and an unlocked condition, said pivot element including a second projection, said slots and projections in predetermined positions so upon assembly of the frame members with said ends overlapping the projections are received in the slots, where each slot of the pair of slots is in the same one frame member, and the first and second projections are each on the other frame member.

2. A locking mechanism for locking together overlapping ends of bed frame members for a bed, comprising a pair of slots in the frame members, a first projection on one frame member, an arm attached by a pivot element to one frame member to rotate between a locked condition and an unlocked condition, said pivot element including a second projection, said slots and projections in predetermined positions so upon assembly of the frame members with said ends overlapping the projections are received in the slots, said arm includes a finger element, said first and second frame members each includes an opening, said openings being aligned upon locking together the frame members, upon said arm being rotated in one direction said finger element being inserted into the aligned openings to lock the frame members together and upon said arm being rotated in the opposite direction said finger element being withdrawn from the aligned openings to allow the frame members to be disconnected, where the frame members each have a substantially L-shaved configuration and each have an end portion including one of said openings, said frame members upon assembly being longitudinally oriented with the end portions overlapping to provide a substantially horizontal top section and a substantially vertical side section, where the arm includes first and second planar arm elements substantially at a right angle to each other with the pivot element attaching the first planar arm element to said vertical side section so the arm is adapted to be rotated vertically upon assembly of the frame members to support the bed.

3. The locking mechanism of claim 2 where the finger element is at or near an end of the second planar arm element, and the second planar arm element is oriented substantially horizontally and abutting the top section when the frame members are locked together with the finger element inserted into the aligned openings.

4. A locking mechanism for a bed comprising a pair of substantially L-shaped bed frame members for a bed, said bed frame members each including an end portion with an opening therein, said openings being aligned when the frame members are longitudinally oriented and the end portions are overlapping to provide a substantially horizontal top section and a substantially vertical side section, a first projection on one of the frame members, a pivot element mounted on one of the frame members, said pivot element including a second projection, a pair of elongated slots in the frame members, one slot receiving the first projection and the other slot receiving the second projection when the frame members are longitudinally oriented and the end portions are overlapping, and an arm attached by the pivot element to said one frame member to rotate between a locked condition and an unlocked condition, said arm having a finger element that is inserted in the aligned openings when in the locked condition and withdrawn from the aligned openings to allow the frame members to be disconnected when in the unlocked condition, where the arm includes first and second planar arm elements substantially at a right angle to each other with the pivot element attaching the first arm element to said vertical section so the arm is adapted to be rotated vertically upon assembly of the frame members to support the bed.

5. The locking mechanism of claim 4 where the finger element is at or near an end of the second arm element, and the second arm element is oriented substantially horizontally and abutting the top section when the frame members are locked together with the finger element inserted into the aligned openings.

6. The locking mechanism of claim 5 where, in a locked condition with the finger inserted in the aligned openings, the second arm element is positioned to be engaged by a bed placed on the bed frame to prevent vertical pivotal movement of the arm.

7. A support frame for a bed, including a pair of side rails, each side rail having attached thereto a pair of crossbar frame members, each crossbar frame member having an inner end connected to the side rail to which it is attached and an outer end, said crossbar frame members on each side rail being spaced apart and the outer ends of individual crossbar frame members of one side rail being aligned with the outer ends of the individual crossbar frame members of the other side rail, said aligned outer ends overlapping and being detachably connected together by a locking mechanism comprising a pair of slots in the frame members, a first projection on one frame member, an arm attached by a pivot element to one frame member to rotate between a locked and unlocked condition, said pivot element including a second projection, said slots and projections in predetermined positions so upon assembly of the frame members the projections are received in the slots, said arm includes a finger element, said frame members each includes an opening, said openings being aligned upon locking together the frame members, upon said arm being rotated in one direction said finger element being inserted into the aligned openings to lock the frame members together and upon said arm being rotated in the opposite direction said finger element being withdrawn from the aligned openings to allow the frame members to be disconnected, where the frame members each have a substantially L-shaped configuration, said frame members upon assembly being longitudinally oriented to provide a substantially horizontal top section and a substantially vertical side section, and the arm includes first and second planar arm elements substantially at a right angle to each other with the pivot element attaching the first arm element to said vertical side section so the arm is adapted to be rotated vertically upon assembly of the frame members to support the bed.

8. The support frame of claim 7 where the finger element is planar and is at or near an end of the second arm element, and the second arm element is oriented substantially horizontally and abutting the top section when the frame members are locked together with the finger element inserted into the aligned openings, and where, in a locked condition with the finger inserted in the aligned openings, the second arm element is positioned to be engaged by a bed placed on the bed frame to prevent vertical pivotal movement of the arm.

9. A support frame for a bed, including a pair of side rails, each side rail having attached thereto a pair of substantially L-shaped crossbar frame members, each crossbar frame member having an inner end connected to the side rail to which it is attached and an outer end including an opening therein, said crossbar frame members on each side rail being spaced apart and the outer ends of individual crossbar frame members of one side rail being aligned with the outer ends of the individual crossbar frame members of the other side rail, each said outer end including an opening therein, said openings in each pair of frame members being in registration when said pair of frame members are longitudinally oriented and the outer ends are overlapping, said aligned outer ends being detachably connected together by a locking mechanism comprising a first projection on one of the frame members, a pivot element mounted on one of the frame members, said pivot element including a second projection, a pair of elongated slots in the frame members, one slot receiving the first projection and the other slot receiving the second projection when the frame members are longitudinally aligned and the end portions are overlapping, said slots each comprising an enlarged open portion and a narrow open portion connected to the enlarged open portion, the individual slots of said pair of slots positioned relative to each other so their respective narrow open portions point towards each other and are in substantial alignment with each other when the frame members are longitudinally oriented and their outer ends are overlapping, with said enlarged narrow open portions being spaced apart a predetermined distance, said individual projections being spaced apart a distance substantially equal to said predetermined distance between said enlarged open portions, and an arm attached by the pivot element to one of frame member to rotate between a locked condition and an unlocked condition, said arm having a finger element that is inserted in the openings in registration when in the locked condition and withdrawn from the openings to allow the frame members to be disconnected when in the unlocked condition.

10. A locking mechanism for locking together overlapping ends of bed frame members for a bed, comprising a pair of slots in the frame members, a first projection on one frame member, an arm attached by a pivot element to one frame member to rotate between a locked condition and an unlocked condition, said pivot element including a second projection, said slots with the projections received in the slots are in predetermined positions so that, upon assembly, said frame members are longitudinally oriented with ends thereof overlapping to provide a substantially horizontal top section and a substantially vertical side section, said ends each including an opening in a corresponding horizontal top section, said openings being aligned upon assembly of the frame members, said arm including first and second planar arm elements substantially at a right angle to each other with the pivot element attaching the first planar arm element to the vertical side section of one frame member so the arm is adapted to be rotated vertically upon assembly of the frame members to support the bed, said second planar arm element terminating in a finger element, upon said arm being rotated vertically in one direction said finger element being inserted into the aligned openings in the horizontal top sections to lock the frame members together and upon said arm being rotated vertically in the opposite direction said finger element being withdrawn from the aligned openings to allow the frame members to be disconnected, in a locked condition with the finger element inserted in the aligned openings in the horizontal top section, the second planar arm element rests on an upper most horizontal top section and is positioned to be engaged by a bed placed on the bed frame to prevent vertical pivotal movement of the arm.

11. A support frame for a bed, including a pair of crossbar frame members, each crossbar frame member having a top wall, a side wall, and an outer end including an opening in the top wall, said crossbar frame members being aligned longitudinally with the outer ends overlapping and the openings in the pair of frame members in registration, said aligned and overlapping outer ends being detachably connected together by a locking mechanism comprising a first projection on a side wall of one of the crossbar frame members, a pivot element mounted on a side wall of one of the frame members, said pivot element including a second projection, a pair of slots in the crossbar frame members, one slot receiving the first projection and the other slot receiving the second projection when the frame members are longitudinally aligned and the ends are overlapping, and an arm attached to a side wall of one of the crossbar frame member by the pivot element to rotate between a locked condition and an unlocked condition, said arm having a finger element that is inserted in the openings in registration in the top walls when in the locked condition and withdrawn from the openings to allow the frame members to be disconnected when in the unlocked condition.

12. A support frame for a bed, including a pair of crossbar frame members, each crossbar frame member having a top wall, a side wall, and an outer end including an opening in the top wall, said crossbar frame members being aligned longitudinally with the outer ends overlapping and the openings in the pair of crossbar frame members in registration, said aligned and overlapping outer ends being detachably connected together by a locking mechanism comprising a first projection on a side wall of one of the crossbar frame members, a pivot element mounted on a side wall of one of the frame members, said pivot element including a second projection, a pair of slots in the crossbar frame members, each slot being in a side wall and one slot receiving the first projection and the other slot receiving the second projection when the frame members are longitudinally aligned and the ends are overlapping, and an arm attached by the pivot element to one frame member to rotate between a locked condition and an unlocked condition upon assembly of the crossbar frame members, said slots and projections in predetermined positions so upon assembly of the crossbar frame members with said ends overlapping the projections are received in the slots.

* * * * *